US009879334B2

(12) United States Patent
Ueda et al.

(10) Patent No.: US 9,879,334 B2
(45) Date of Patent: Jan. 30, 2018

(54) ABRASION RESISTANT STEEL PLATE OR STEEL SHEET EXCELLENT IN RESISTANCE TO STRESS CORROSION CRACKING AND METHOD FOR MANUFACTURING THE SAME

(75) Inventors: Keiji Ueda, Chiba (JP); Yasuhiro Murota, Kawasaki (JP); Nobuyuki Ishikawa, Fukuyama (JP)

(73) Assignee: JFE STEEL CORPORATION, Tokyo (JP)

( * ) Notice: Subject to any disclaimer, the term of this patent is extended or adjusted under 35 U.S.C. 154(b) by 552 days.

(21) Appl. No.: 14/008,104

(22) PCT Filed: Mar. 28, 2012

(86) PCT No.: PCT/JP2012/059126

§ 371 (c)(1),
(2), (4) Date: Dec. 6, 2013

(87) PCT Pub. No.: WO2012/133910

PCT Pub. Date: Oct. 4, 2012

(65) Prior Publication Data

US 2014/0090755 A1 Apr. 3, 2014

(30) Foreign Application Priority Data

Mar. 29, 2011 (JP) ..... 2011-071264

(51) Int. Cl.
*C22C 38/02* (2006.01)
*C22C 38/50* (2006.01)
(Continued)

(52) U.S. Cl.
CPC ..... *C22C 38/50* (2013.01); *C21D 8/0263* (2013.01); *C22C 38/001* (2013.01);
(Continued)

(58) Field of Classification Search
CPC ..... C22C 38/02; C22C 38/50
(Continued)

(56) References Cited

U.S. PATENT DOCUMENTS

2009/0010794 A1 1/2009 Turconi et al.
2010/0059150 A1 3/2010 Saitoh

FOREIGN PATENT DOCUMENTS

EP 2 589 675 A1 5/2013
EP 2 589 676 A1 5/2013
(Continued)

OTHER PUBLICATIONS

International Search Report issued in International Application No. PCT/JP2012/059126 dated May 22, 2012.
(Continued)

*Primary Examiner* — Brian Walck
(74) *Attorney, Agent, or Firm* — Oliff PLC

(57) ABSTRACT

Provided is an abrasion resistant steel plate or steel sheet, suitable for use in construction machines, industrial machines, and the like, and a method for manufacturing the same. A steel plate or steel sheet has a composition containing 0.20% to 0.27% C, 0.05% to 1.0% Si, 0.30% to 0.90% Mn, P, S, 0.005% to 0.025% Nb, 0.008% to 0.020% Ti, 0.1% or less Al, and 0.0010% to 0.0060% N on a mass % basis, the composition further containing one or more of Cr, Mo, W, and B, the composition containing one or more of Cu, Ni, V, an REM, Ca, and Mg as required, the remainder being Fe and inevitable impurities. After being heated, a semi-finished product having the steel composition is hot-rolled and is subjected to reheat-quenching or direct quenching.

8 Claims, 2 Drawing Sheets

(51) Int. Cl.

| | |
|---|---|
| ***C22C 38/04*** | (2006.01) |
| ***C22C 38/06*** | (2006.01) |
| ***C22C 38/22*** | (2006.01) |
| ***C22C 38/26*** | (2006.01) |
| ***C22C 38/28*** | (2006.01) |
| ***C21D 8/02*** | (2006.01) |
| ***C22C 38/00*** | (2006.01) |
| ***C22C 38/20*** | (2006.01) |
| ***C22C 38/24*** | (2006.01) |
| ***C22C 38/32*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| *C21D 8/04* | (2006.01) |
| *C21D 1/25* | (2006.01) |

(52) U.S. Cl.
CPC ..... *C22C 38/002* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/42* (2013.01); *C22C 38/44* (2013.01); *C22C 38/46* (2013.01); *C22C 38/48* (2013.01); *C21D 1/25* (2013.01); *C21D 8/0426* (2013.01); *C21D 8/0463* (2013.01); *C21D 8/0473* (2013.01); *C21D 2211/008* (2013.01)

(58) Field of Classification Search
USPC ..... 148/320, 330–336, 645
See application file for complete search history.

(56) References Cited

FOREIGN PATENT DOCUMENTS

| | | |
|---|---|---|
| JP | A-1-172550 | 7/1989 |
| JP | A-5-51691 | 3/1993 |
| JP | A-8-295990 | 11/1996 |
| JP | A-9-118950 | 5/1997 |
| JP | A-11-71631 | 3/1999 |
| JP | A-2000-297344 | 10/2000 |
| JP | A-2002-80930 | 3/2002 |
| JP | A-2002-115024 | 4/2002 |
| JP | A-2004-162120 | 6/2004 |
| JP | A-2007-70713 | 3/2007 |
| JP | 2008-248315 A | 10/2008 |
| JP | A-2009-30092 | 2/2009 |
| JP | A-2009-30093 | 2/2009 |
| JP | A-2009-030094 | 2/2009 |
| JP | 2009-242816 A | 10/2009 |
| JP | A-2010-121191 | 6/2010 |

OTHER PUBLICATIONS

Extended European Search Report issued in Application No. 12765557.9 dated Nov. 3, 2014.
Nov. 17, 2015 Office Action issued in Japanese Patent Application No. 2012-073808.
Mar. 29. 2016 Office Action issued in Japanese Patent Application No. 2012-073808.
Aug. 23, 2016 Office Action issued in Japanese Patent Application No. 2012-073808.
Apr. 3, 2017 Office Action issued in European Patent Application No. 12 765 557.9.

ABRASION RESISTANT STEEL PLATE OR STEEL SHEET EXCELLENT IN RESISTANCE TO STRESS CORROSION CRACKING AND METHOD FOR MANUFACTURING THE SAME

TECHNICAL FIELD

The present invention relates to abrasion resistant steel plates or steel sheets, having a thickness of 4 mm or more, suitable for use in construction machines, industrial machines, shipbuilding, steel pipes, civil engineering, architecture, and the like and particularly relates to steel plates or steel sheets excellent in resistance to stress corrosion cracking.

BACKGROUND ART

In the case where hot-rolled steel plates or steel sheets are used in construction machines, industrial machines, shipbuilding, steel pipes, civil engineering, steel structures such as buildings, machinery, equipment, or the like, abrasion resistant property is required for such steel plates or steel sheets in some cases. Abrasion is a phenomenon that occurs at moving parts of machines, apparatus, or the like because of the continuous contact between steels or between steel and another material such as soil or rock and therefore a surface portion of steel is scraped off.

When the abrasion resistant property of steel is poor, the failure of machinery or equipment is caused and there is a risk that the strength of structures cannot be maintained; hence, the frequent repair or replacement of worn parts is unavoidable. Therefore, there is a strong demand for an increase in abrasion resistant property of steel used in wearing parts.

In order to allow steel to have excellent abrasion resistant property, the hardness thereof has been generally increased. The hardness thereof can be significantly increased by adopting a martensite single-phase microstructure. Increasing the amount of solid solution carbon is effective in increasing the hardness of a martensite microstructure. Therefore, various abrasion resistant steel plates and steel sheets have been developed (for example, Patent Literatures 1 to 5).

On the other hand, when abrasion resistant property is required for portions of a steel plate or steel sheet, in many cases, the surface of base metal is exposed. The surface of steel contacts water vapor, moisture, or oil containing a corrosive material and the steel is corroded.

In the case where abrasion resistant steel is used in mining machinery including ore conveyers, moisture in soil and a corrosive material such as hydrogen sulfide are present. In the case where abrasion resistant steel is used in construction machinery or the like, moisture and sulfuric oxide, which are contained in diesel engines, are present. Both cases are often very severe corrosion environments. In these cases, for corrosion reactions on the surface of steel, iron produces an oxide (rust) by an anode reaction and hydrogen is produced by the cathode reaction of moisture.

In the case where hydrogen produced by a corrosion reaction permeates high-hardness steel, such as abrasion resistant steel, having a martensite microstructure, the steel is extremely embrittled and is cracked in the presence of welding residual stress due to bending work or welding or applied stress in the environment of usage. This is stress corrosion cracking. From the viewpoint of operation safety, it is important for steel for use in machinery, equipment, or the like to have excellent abrasion resistance and resistance to stress corrosion cracking.

CITATION LIST

Patent Literature

[PTL 1] Japanese Unexamined Patent Application Publication No. 5-51691

[PTL 2] Japanese Unexamined Patent Application Publication No. 8-295990

[PTL 3] Japanese Unexamined Patent Application Publication No. 2002-115024

[PTL 4] Japanese Unexamined Patent Application Publication No. 2002-80930

[PTL 5] Japanese Unexamined Patent Application Publication No. 2004-162120

Non Patent Literature

[NPL 1] Standard test method for stress corrosion cracking standardized by the 129th Committee (The Japanese Society for Strength and Fracture of Materials, 1985), Japan Society for the Promotion of Science

SUMMARY OF INVENTION

Technical Problem

However, abrasion resistant steels proposed in Patent Literatures 1 to 5 are directed to have base material toughness, delayed fracture resistance (the above for Patent Literatures 1, 3, and 4), weldability, abrasion resistance for welded portions, and corrosion resistance in condensate corrosion environments (the above for Patent Literature 5) and do not have excellent resistance to stress corrosion cracking or abrasion resistance as determined by a standard test method for stress corrosion cracking specified in Non Patent Literature 1.

It is an object of the present invention to provide an abrasion resistant steel plate or steel sheet which is excellent in economic efficiency and excellent in resistance to stress corrosion cracking and which does not cause a reduction in productivity or an increase in production cost and a method for manufacturing the same.

Solution to Problem

In order to achieve the above object, the inventors have intensively investigated various factors affecting chemical components of a steel plate or steel sheet, a manufacturing method, and a microstructure for the purpose of ensuring excellent resistance to stress corrosion cracking for an abrasion resistant steel plate or steel sheet. The inventors have obtained findings below.

1. Ensuring high hardness is essential to ensure excellent abrasion resistance. However, an excessive increase in hardness causes a significant reduction in resistance to stress corrosion cracking. Therefore, it is important to strictly control the range of hardness. Furthermore, in order to enhance the resistance to stress corrosion cracking, it is effective that cementite, which acts as trap sites for diffusible hydrogen, is dispersed in a steel plate or steel sheet. Therefore, it is important that the base microstructure of a steel plate or steel sheet is made tempered martensite in such a manner that the chemical compositions of the steel plate or steel sheet including C is strictly controlled.

Carbides, nitrides, and complex carbonitrides of Nb and/or Ti in tempered martensite act as trap sites for diffusible hydrogen produced by a corrosion reaction of steel and have the effect of suppressing hydrogen embrittlement cracking if the dispersion state thereof is appropriately controlled.

Rolling conditions, heat treatment conditions, cooling conditions, and the like affect the dispersion state of the carbides, nitrides, and complex carbonitrides of Nb and/or Ti in tempered martensite. It is important to control these manufacturing conditions. This allows grain boundary fracture to be suppressed in corrosive environments and also allows stress corrosion cracking to be efficiently prevented.

2. Furthermore, in order to efficiently suppress the grain boundary fracture of a tempered martensite microstructure, a measure to increase grain boundary strength is effective, an impurity element such as P needs to be reduced, and the content range of Mn needs to be controlled. Mn is an element which has the effect of enhancing hardenability to contribute to the enhancement of abrasion resistance and which is likely to co-segregate with P in the solidification process of semi-finished products to reduce the grain boundary strength of a micro-segregation zone.

In order to efficiently suppress grain boundary fracture, the refining of grains is effective and the dispersion of fine inclusions having the pinning effect of suppressing the growth of grains is also effective. Therefore, it is effective that carbonitrides are dispersed in steel by adding Nb and Ti thereto.

The present invention has been made by further reviewing the obtained findings and is as follows:

1. An abrasion resistant steel plate or steel sheet excellent in resistance to stress corrosion cracking has a composition containing 0.20% to 0.27% C, 0.05% to 1.0% Si, 0.30% to 0.90% Mn, 0.010% or less P, 0.005% or less S, 0.005% to 0.025% Nb, 0.008% to 0.020% Ti, 0.1% or less Al, 0.0010% to 0.0060% N, and one or more of 0.05% to 1.5% Cr, 0.05% to 1.0% Mo, 0.05% to 1.0% W, and 0.0003% to 0.0030% B on a mass % basis, the remainder being Fe and inevitable impurities. The abrasion resistant steel plate or steel sheet has a hardenability index DI* of 45 or more as represented by Equation (1) below and a microstructure having a base phase or main phase that is tempered martensite. A carbide, nitride, or carbonitride which has a grain size of 0.01 μm to 0.5 μm in terms of equivalent circle diameter and which contains one or both of Nb and Ti is present therein at $2\times10^2$ grains/mm$^2$ or more.

$$DI^*=33.85\times(0.1\times C)^{0.5}\times(0.7\times Si+1)\times(3.33\times Mn+1)\times(0.35\times Cu+1)\times(0.36\times Ni+1)\times(2.16\times Cr+1)\times(3\times Mo+1)\times(1.75\times V+1)\times(1.5\times W+1) \quad (1)$$

where each alloy element symbol represents the content (mass percent) and is 0 when being not contained.

2. In the abrasion resistant steel plate or steel sheet, specified in Item 1, excellent in resistance to stress corrosion cracking, the steel composition further contains one or more of 1.5% or less Cu, 2.0% or less Ni, and 0.1% or less V on a mass % basis.
3. In the abrasion resistant steel plate or steel sheet, specified in Item 1 or 2, excellent in resistance to stress corrosion cracking, the steel composition further contains one or more of 0.008% or less of an REM (rare-earth metal), 0.005% or less Ca, and 0.005% or less Mg on a mass % basis.
4. Furthermore, in the abrasion resistant steel plate or steel sheet, specified in any one of Items 1 to 3, excellent in resistance to stress corrosion cracking, the average grain size of tempered martensite is 15 μm or less in terms of equivalent circle diameter.
5. Furthermore, in the abrasion resistant steel plate or steel sheet, specified in any one of Items 1 to 4, excellent in resistance to stress corrosion cracking, the surface hardness is 400 to 520 HBW 10/3000 in terms of Brinell hardness.
6. A method for manufacturing an abrasion resistant steel plate or steel sheet excellent in resistance to stress corrosion cracking includes heating a semi-finished product having the steel composition specified in any one of Items 1 to 3 to 1,000° C. to 1,200° C., performing hot rolling, performing cooling, performing reheating at Ac3 to 950° C., and then performing quenching.
7. A method for manufacturing an abrasion resistant steel plate or steel sheet excellent in resistance to stress corrosion cracking includes heating a semi-finished product having the steel composition specified in any one of Items 1 to 3 to 1,000° C. to 1,200° C., performing hot rolling at a temperature of 850° C. or higher, and performing quenching at a temperature of Ar3 to 950° C. immediately after finishing the hot rolling.

In the present invention, the average grain size of tempered martensite is determined in terms of the equivalent circle diameter of prior-austenite grains on the assumption that tempered martensite is the prior-austenite grains.

Advantageous Effects of Invention

According to the present invention, the following plate or sheet is obtained: an abrasion resistant steel plate or steel sheet which is excellent in economic efficiency and excellent in resistance to stress corrosion cracking and which does not cause a reduction in productivity or an increase in production cost. This greatly contributes to enhancing the safety and life of steel structures and provides industrially remarkable effects.

DESCRIPTION OF EMBODIMENTS

[Microstructure]

Figure 1:
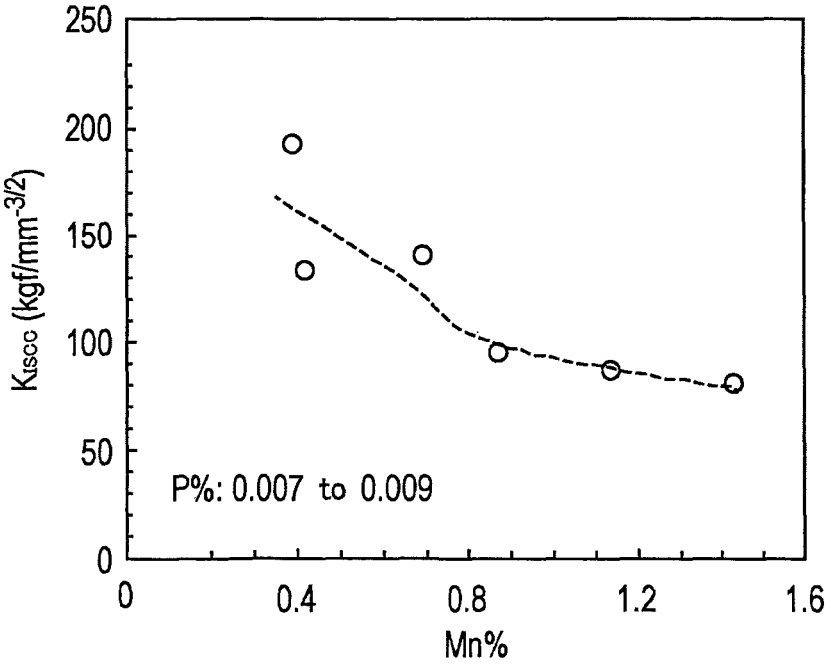
FIG. 1 is a graph showing the relationship between the resistance to stress corrosion cracking ($K_{ISCC}$) and the Mn content of abrasion resistant steels (those having a Brinell hardness of 450 to 500 HBW 10/3000) having a P content of 0.007% to 0.009%.

In the present invention, the base phase or main phase of the microstructure of a steel plate or steel sheet is martensite and the state of a carbide, nitride, or carbonitride (hereinafter referred to as the Nb/Ti-containing precipitate), containing one or both of Nb and Ti, present in the microstructure is specified.

The Nb/Ti-containing precipitate has a grain size of 0.01 μm to 0.5 μm in terms of equivalent circle diameter. When the grain size is less than 0.01 μm, the effect of suppressing hydrogen embrittlement cracking by trap sites for diffusible hydrogen is saturated and manufacturing cost is increased because manufacturing load is extremely increased in order to control the grain size to be less than 0.01 μm in actual manufacturing. In contrast, when the grain size is more than 0.5 μm, the effect of suppressing the coarsening of grains during hot rolling and heat treatment or the effect of suppressing hydrogen embrittlement cracking by the trap sites for diffusible hydrogen is not achieved.

When the Nb/Ti-containing precipitate, which has the above grain size, in the microstructure is less than $2\times10^2$ grains/mm$^2$, the effect of suppressing the coarsening of grains during hot rolling and heat treatment or the effect of suppressing hydrogen embrittlement cracking by the trap sites for diffusible hydrogen is not achieved. Therefore, the Nb/Ti-containing precipitate is $2\times10^2$ grains/mm$^2$ or more.

In the present invention, in the case of further increasing the resistance to stress corrosion cracking, the base phase or main phase of the microstructure of the steel plate or steel sheet is made tempered martensite having an average grain size of 15 μm or less in terms of equivalent circle diameter. In order to ensure the abrasion resistance of the steel plate or steel sheet, a tempered martensite microstructure is necessary. However, when the average grain size of tempered martensite is more than 15 μm in terms of equivalent circle diameter, the resistance to stress corrosion cracking is deteriorated. Therefore, the average grain size of tempered martensite is preferably 15 μm or less.

When microstructures such as bainite, pearlite, and ferrite are present in the base phase or main phase in addition to tempered martensite, the hardness is reduced and the abrasion resistance is reduced. Therefore, the smaller area fraction of these microstructures is preferable. When these microstructures are present therein, the area ratio is preferably 5% or less.

On the other hand, when martensite is present, the resistance to stress corrosion cracking is reduced. Therefore, the smaller area fraction of martensite is preferable. Martensite may be contained because the influence thereof is negligible when the area ratio thereof is 10% or less.

When the surface hardness is less than 400 HBW 10/3000 in terms of Brinell hardness, the life of abrasion resistant steel is short. In contrast, when the surface hardness is more than 520 HBW 10/3000, the resistance to stress corrosion cracking is remarkably deteriorated. Therefore, the surface hardness preferably ranges from 400 to 520 HBW 10/3000 in terms of Brinell hardness.

[Composition]

In the present invention, in order to ensure excellent resistance to stress corrosion cracking, the composition of the steel plate or steel sheet is specified. In the description, percentages are on a mass % basis.

C: 0.20% to 0.27%

C is an element which is important in increasing the hardness of martensite and in ensuring excellent abrasion resistance. In order to achieve this effect, the content thereof needs to be 0.20% or more. However, when the content is more than 0.27%, the hardness of martensite excessively increased and the resistance to stress corrosion cracking is reduced. Therefore, the content is limited to the range from 0.20% to 0.27%. The content is preferably 0.21% to 0.26%.

Si: 0.05% to 1.0%

Si acts as a deoxidizing agent, is necessary for steelmaking, and dissolves in steel to have an effect to harden the steel plate or steel sheet by solid solution strengthening. In order to achieve such an effect, the content thereof needs to be 0.05% or more. However, when the content is more than 1.0%, the weldability is deteriorated. Therefore, the content is limited to the range from 0.05% to 1.0%. The content is preferably 0.07% to 0.5%.

Mn: 0.30% to 0.90%

Mn has the effect of increasing the hardenability of steel. In order to ensure the hardness of a base material, the content needs to be 0.30% or more. However, when the content is more than 0.90%, the toughness, ductility, and weldability of the base material are deteriorated, the intergranular segregation of P is increased, and the occurrence of stress corrosion cracking is promoted. FIG. 1 shows the relationship between the resistance to stress corrosion cracking ($K_{ISCC}$) and the Mn content of abrasion resistant steels (those having a Brinell hardness of 450 to 500 HBW 10/3000) having a P content of 0.007% to 0.009%. An experiment method is the same as that for an example below. The $K_{ISCC}$ value, that is, the resistance to stress corrosion cracking decreases with the increase of the Mn content. The Mn content is limited to the range from 0.30% to 0.90%. The Mn content is preferably 0.35% to 0.85%.

P: 0.010% or less

Figure 2:
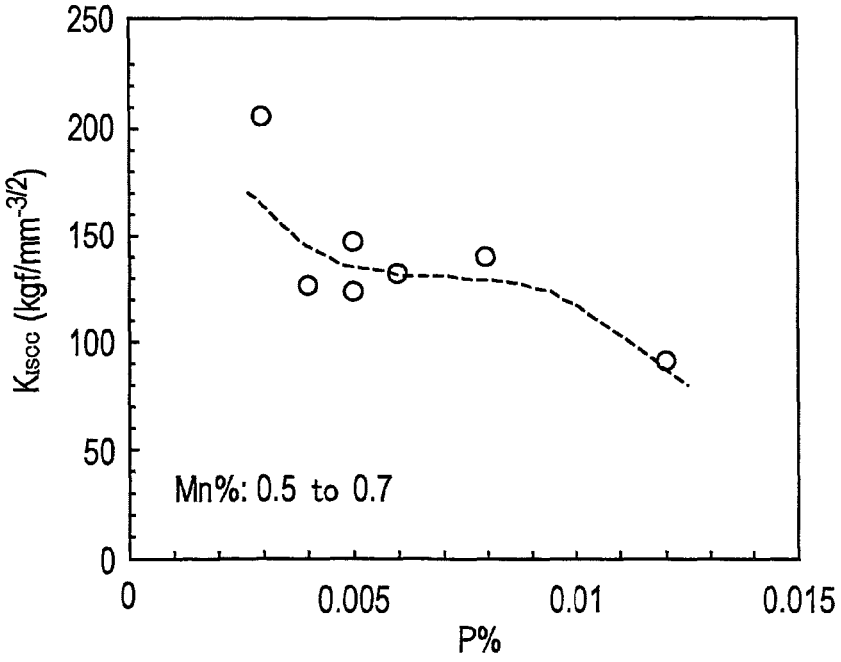
FIG. 2 is a graph showing the relationship between the resistance to stress corrosion cracking ($K_{ISCC}$) and the P content of abrasion resistant steels (those having a Brinell hardness of 450 to 500 HBW 10/3000) having a Mn content of 0.5% to 0.7%.

When the content of P is more than 0.010%, P segregates at grain boundaries to act as the origin of stress corrosion cracking. FIG. 2 shows the relationship between the resistance to stress corrosion cracking ($K_{ISCC}$) and the P content of abrasion resistant steels (those having a Brinell hardness of 450 to 500 HBW 10/3000) having a Mn content of 0.5% to 0.7%. It is clear that the $K_{ISCC}$ value decreases with the increase of the P content. Therefore, the P content is up to 0.010% and is preferably minimized. The P content is preferably 0.0085% or less.

S: 0.005% or less

S deteriorates the low-temperature toughness or ductility of the base material. Therefore, the S content is up to 0.005% and the lower content is preferable. The S content is preferably 0.003% or less and more preferably 0.002% or less.

Nb: 0.005% to 0.025%

Nb is an important element. Nb precipitates in the form of a carbonitride to refine the microstructure of the base material and a weld heat-affected zone, and fixes solute N to improve the toughness. The carbonitride is effective as trap sites for diffusible hydrogen, and has the effect of suppressing stress corrosion cracking. In order to achieve such effects, the content thereof needs to be 0.005% or more. However, when the content is more than 0.025%, coarse carbonitrides precipitate to act as the origin of a fracture in some cases. Therefore, the content is limited to the range from 0.005% to 0.025%.

Ti: 0.008% to 0.020%

Ti has the effect of suppressing the coarsening of grains by forming a nitride or by forming a carbonitride with Nb and the effect of suppressing the deterioration of toughness due to the reduction of solute N. Furthermore, a carbonitride produced therefrom is effective for trap sites for diffusible hydrogen. Ti is an important element which has the effect of suppressing stress corrosion cracking. In order to achieve such effects, the content thereof needs to be 0.008% or more. However, when the content is more than 0.020%, precipitates are coarsened and the toughness of the base material is deteriorated. Therefore, the content is limited to the range from 0.008% to 0.020%.

Al: 0.1% or less

Al acts as a deoxidizing agent and is most commonly used in deoxidizing processes for molten steel for steel plates or steel sheets. Al has the effect of fixing solute N in steel to form AlN to suppress the coarsening of grains and the effect of reducing solute N to suppress the deterioration of toughness. However, when the content thereof is more than 0.1%, a weld metal is contaminated therewith during welding and the toughness of the weld metal is deteriorated. Therefore, the content is limited to 0.1% or less. The content is preferably 0.08% or less.

N: 0.0010% to 0.0060%

N, which combines with Ti and/or Nb to precipitate in the form of a nitride or a carbonitride, has the effect of suppressing the coarsening of grains during hot rolling and heat treatment. N also has the effect of suppressing hydrogen embrittlement cracking because the nitride or the carbonitride acts as a trap site for diffusible hydrogen. In order to achieve such effects, 0.0010% or more N needs to be contained. However, when more than 0.0060% N is contained, the amount of solute N is increased and the toughness is significantly reduced. Therefore, the content of N is limited to 0.0010% to 0.0060%.

One or more of Cr, Mo, W, and B

Cr: 0.05% to 1.5%

Cr is an element which is effective in increasing the hardenability of steel to harden the base material. In order to achieve such an effect, 0.05% or more Cr needs to be contained. However, when more than 1.5% Cr is contained, the toughness of the base material and weld cracking resistance are reduced. Therefore, the content is limited to the range from 0.05% to 1.5%.

Mo: 0.05% to 1.0%

Mo is an element which is effective in increasing the hardenability to harden the base material. In order to achieve such an effect, the content is preferably 0.05% or more. However, when the content is more than 1.0%, the toughness of the base material, ductility, and weld crack resistance are adversely affected. Therefore, the content is 1.0% or less.

W: 0.05% to 1.0%

W is an element which is effective in significantly increasing the hardenability to harden the base material. In order to achieve such an effect, the content is preferably 0.05% or more. However, when the content is more than 1.0%, the toughness of the base material, ductility, and weld crack resistance are adversely affected. Therefore, the content is 1.0% or less.

B: 0.0003% to 0.0030%

B is an element which is effective in significantly increasing the hardenability even with a slight amount of addition to harden the base material. In order to achieve such an effect, the content is preferably 0.0003% or more. However, when the content is more than 0.0030%, the toughness, ductility, and weld crack resistance of the base material are adversely affected. Therefore, the content is 0.0030% or less.

$$DI^*=33.85\times(0.1\times C)^{0.5}\times(0.7\times Si+1)\times(3.33\times Mn+1)\times(0.35\times Cu+1)\times(0.36\times Ni+1)\times(2.16\times Cr+1)\times(3\times Mo+1)\times(1.75\times V+1)\times(1.5\times W+1)$$

where each alloy element symbol represents the content (mass percent) and is 0 when being not contained.

In order to make the base microstructure of the base material tempered martensite to increase the abrasion resistance, it is important that DI*, which is given by the above equation, is 45 or more. When DI* is less than 45, the depth of hardening from a surface of a plate is below 10 mm and the life of abrasion resistant steel is short. Therefore, DI* is 45 or more.

The above is the basic composition of the present invention and the remainder is Fe and inevitable impurities. In the present invention, in the case of increasing strength properties, one or more of Cu, Ni, and V may be further contained. Each of Cu, Ni, and V is an element contributing to increasing the strength of steel and is appropriately contained depending on desired strength.

When Cu is contained, the content is 1.5% or less. This is because when the content is more than 1.5%, hot brittleness is caused and therefore the surface property of the steel plate or steel sheet is deteriorated.

When Ni is contained, the content is 2.0% or less. This is because when the content is more than 2.0%, an effect is saturated, which is economically disadvantageous. When V is contained, the content is 0.1% or less. This is because when the content is more than 0.1%, the toughness and ductility of the base material are deteriorated.

In the present invention, in the case of increasing the toughness, one or more of an REM, Ca, and Mg may be further contained. The REM, Ca, and Mg contribute to increasing the toughness and are selectively contained depending on desired properties.

When the REM is contained, the content is preferably 0.002% or more. However, when the content is more than 0.006%, an effect is saturated. Therefore, the upper limit thereof is 0.008%. When Ca is contained, the content is preferably 0.0005% or more. However, when the content is more than 0.005%, an effect is saturated. Therefore, the upper limit thereof is 0.005%. When Mg is contained, the content is preferably 0.001% or more. However, when the content is more than 0.005%, an effect is saturated. Therefore, the upper limit thereof is 0.005%.

[Manufacturing Conditions]

In the description, the symbol "° C." concerning temperature represents the temperature of a location corresponding to half the thickness of a plate.

An abrasion resistant steel plate or steel sheet according to the present invention is preferably as follows: molten steel having the above composition is produced by a known steelmaking process and is then formed into a steel material, such as a slab or the like, having a predetermined size by continuous casting or an ingot casting-blooming method.

Next, the obtained steel material is reheated to 1,000° C. to 1,200° C. and is then hot-rolled into a steel plate or steel sheet with a desired thickness. When the reheating temperature is lower than 1,000° C., deformation resistance in hot rolling is too high so that the rolling reduction per pass cannot be enough; hence, the number of rolling passes is increased to reduce rolling efficiency, and cast defects in the steel material (slab) cannot be pressed off in some cases.

However, when the reheating temperature is higher than 1,200° C., surface scratches are likely to be caused by scales during heating and a repair work after rolling is increased. Therefore, the reheating temperature of the steel material ranges from 1,000° C. to 1,200° C. In the case of performing hot direct rolling, the hot rolling of the steel material is started at 1,000° C. to 1,200° C. Conditions for hot rolling are not particularly limited.

In order to equalize the temperature in the hot-rolled steel plate or steel sheet and in order to suppress characteristic variations, reheating treatment is performed after air cooling subsequent to hot rolling. The transformation of the steel plate or steel sheet to ferrite, bainite, or martensite needs to be finished before reheating treatment. Therefore, the steel plate or steel sheet is cooled to 300° C. or lower, preferably 200° C. or lower, and more preferably 100° C. or lower before reheating treatment. Reheating treatment is performed after cooling. When the reheating temperature is not higher than Ac3, ferrite is present in the microstructure and the hardness is reduced. However, when the reheating temperature is higher than 950° C., grains are coarsened and the toughness and resistance to stress corrosion cracking are reduced. Therefore, the reheating temperature is Ac3 to 950° C. Ac3 (° C.) can be determined by, for example, the following equation:

$$Ac3=854-180C+44Si-14Mn-17.8Ni-1.7Cr$$

where each of C, Si, Mn, Ni, and Cr is the content (mass percent) of a corresponding one of alloy elements.

The holding time for reheating may be short if the temperature in the steel plate or steel sheet becomes uniform. However, when the holding time is long, grains are coarsened and the toughness and resistance to stress corrosion cracking are reduced. Therefore, the holding time is preferably 1 hr or less. In the case of performing reheating after hot rolling, the hot-rolling finishing temperature is not particularly limited.

Quenching (RQ) is performed after reheating. In the case where characteristics of the steel plate or steel sheet are equalized and the resistance to stress corrosion cracking is increased, tempering may be performed by reheating to 100° C. to 300° C. When the tempering temperature is higher than 300° C., the hardness is significantly reduced, the abrasion resistance is reduced, produced cementite is coarsened, and an effect as a trap site for diffusible hydrogen is not achieved.

However, when the tempering temperature is lower than 100° C., the above effect is not achieved. The holding time may be short if the temperature in the steel plate or steel sheet becomes uniform. However, when the holding time is long, produced cementite is coarsened and an effect as a trap site for diffusible hydrogen is reduced. Therefore, the holding time is preferably 1 hr or less.

In the case where reheating treatment is not performed after hot rolling, the hot-rolling finishing temperature may be Ar3 to 950° C. and quenching (DQ) may be performed immediately after finishing the rolling. When the initial quenching temperature (substantially equal to the hot-rolling finishing temperature) is lower than Ar3, ferrite is present in the microstructure and the hardness is reduced. However, when the initial quenching temperature is 950° C. or higher, grains are coarsened and the toughness and resistance to stress corrosion cracking are reduced. Therefore, the initial quenching temperature is Ar3 to 950° C. The Ar3 point can be determined by, for example, the following equation:

$$Ar3=868-396C+25Si-68Mn-21Cu-36Ni-25Cr-30Mo$$

where each of C, Si, Mn, Cu, Ni, Cr, and Mo is the content (mass percent) of a corresponding one of alloy elements. The case of performing tempering treatment after quenching is substantially the same as the case of performing reheating after hot rolling.

EXAMPLES

Steel slabs were prepared by a steel converter-ladle refining-continuous casting process so as to have various compositions shown in Tables 1-1 and 1-2, were heated to 950° C. to 1,250° C., and were then hot-rolled into steel plates. Some of the steel plates were quenched (DQ) immediately after rolling. The other steel plates were air-cooled after rolling, were reheated, and were then quenched (RQ).

The obtained steel plates were investigated for microstructure, were measured for surface hardness, and were tested for base material toughness and resistance to stress corrosion cracking.

The investigation of microstructure was as follows: a sample for microstructure observation was taken from a cross section of each obtained steel plate, the cross section being parallel to a rolling direction was subjected to nital corrosion treatment (etching), the cross section was photographed at a location of ¼ thickness of the plate using an optical microscope with a magnification of 500 times power, and the microstructure of the plate was then evaluated.

The evaluation of the average grain size of tempered martensite was as follows: a cross section being parallel to the rolling direction of each steel plate was subjected to picric acid etching, the cross section at a location of ¼ thickness of the plate were photographed at a magnification of 500 times power using an optical microscope, five views of each sample were analyzed by image analyzing equipment. The average grain size of tempered martensite was determined in terms of the equivalent circle diameter of prior-austenite grains on the assumption that the size of tempered martensite grains is equal to the size of the prior-austenite grains.

The investigation of the number-density of Nb/Ti-containing precipitates in a tempered martensite microstructure was as follows: a cross section being parallel to the rolling direction at a ¼ thickness of each steel plate were photographed at a magnification of 50,000 times power using a transmission electron microscope, and the number of the Nb/Ti-containing precipitates was counted in ten views of the each steel plate.

The surface hardness was measured in accordance with JIS Z 2243 (1998) in such a manner that the surface hardness under a surface layer (the hardness of a surface under surface layer; surface hardness measured after scales (surface layer) were removed) was measured. For measurement, a 10 mm tungsten hard ball was used and the load was 3,000 kgf.

Three Charpy V-notch test specimens were taken from a location corresponding to one-fourth of the thickness of each steel plate in a direction perpendicular to the rolling direction in accordance with JIS Z 2202 (1998). Each steel plate was subjected to a Charpy impact test in accordance with JIS Z 2242 (1998) and the absorbed energy at −20° C. was determined three times for the each steel plate, whereby the base material toughness was evaluated. Those of which the average of three absorbed energy ($vE_{-20}$) was 30 J or more were judged to be excellent in base material toughness (within the scope of the present invention).

Figure 3:
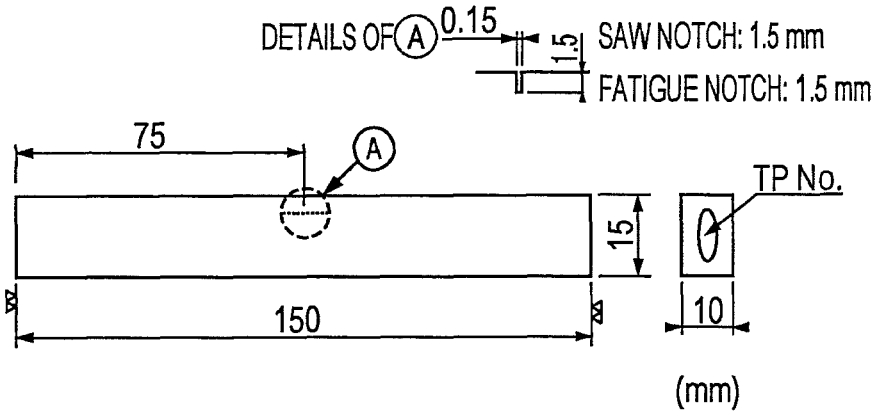
FIG. 3 is an illustration showing the shape of a test specimen used in a stress corrosion cracking test.
Figure 4:
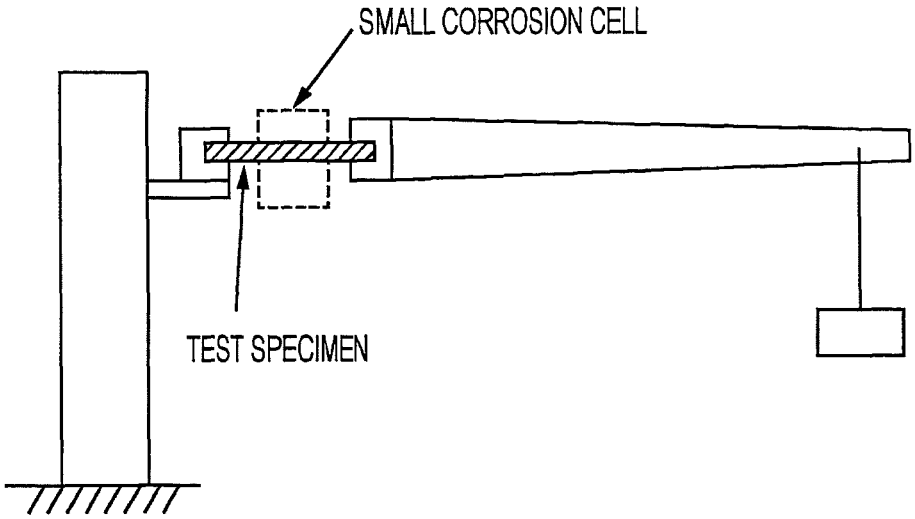
FIG. 4 is an illustration showing the configuration of a tester using the test specimen shown in FIG. 3.

A stress corrosion cracking test was performed in accordance with a standard test method for stress corrosion cracking standardized by the 129th Committee (The Japanese Society for Strength and Fracture of Materials, 1985). FIG. 3 shows the shape of a test specimen. FIG. 4 shows the configuration of a tester. Test conditions were as follows: a test solution containing 3.5% NaCl and having a pH of 6.7 to 7.0, a test temperature of 30° C., and a maximum test time of 500 hours. The threshold stress intensity factor ($K_{ISCC}$) for stress corrosion cracking was determined under the test conditions. Performance targets of the present invention were a surface hardness of 400 to 520 HBW 10/3000, a base material toughness of 30 J or more, and a $K_{ISCC}$ of 100 $kgf/mm^{-3/2}$ or more.

Tables 2-1 to 2-4 show conditions for manufacturing the tested steel plates and results of the above test. It was confirmed that inventive examples (Nos. 1 and 4 to 12) meet the performance targets. However, comparative examples (Nos. 2, 3, and 13 to 28) cannot meet any one of the surface hardness, the base material toughness, and the resistance to stress corrosion cracking or some of the performance targets.

TABLE 1-1

| Steel type | C | Si | Mn | P | S | Al | Nb | Ti | Cr | Mo | W | Cu | Ni | V | Remarks |
|---|---|---|---|---|---|---|---|---|---|---|---|---|---|---|---|
| | (mass percent) | | | | | | | | | | | | | | |
| A | 0.245 | 0.47 | 0.79 | 0.004 | 0.0012 | 0.033 | 0.015 | 0.012 | 0.39 | — | — | — | — | — | Inventive example |
| B | 0.264 | 0.27 | 0.55 | 0.006 | 0.0010 | 0.024 | 0.011 | 0.015 | — | 0.51 | — | — | — | — | Inventive example |
| C | 0.218 | 0.71 | 0.83 | 0.007 | 0.0019 | 0.041 | 0.024 | 0.009 | — | — | 0.62 | — | — | — | Inventive example |
| D | 0.253 | 0.54 | 0.69 | 0.008 | 0.0011 | 0.030 | 0.009 | 0.016 | 0.71 | — | — | — | — | — | Inventive example |
| E | 0.224 | 0.11 | 0.39 | 0.008 | 0.0012 | 0.027 | 0.022 | 0.014 | — | 0.44 | 0.18 | 0.41 | 0.48 | — | Inventive example |
| F | 0.251 | 0.36 | 0.67 | 0.005 | 0.0014 | 0.032 | 0.016 | 0.015 | 0.27 | 0.15 | — | — | — | — | Inventive example |
| G | 0.239 | 0.61 | 0.42 | 0.009 | 0.0028 | 0.054 | 0.019 | 0.018 | 0.44 | 0.32 | 0.29 | — | — | — | Inventive example |
| H | 0.213 | 0.22 | 0.71 | 0.003 | 0.0007 | 0.032 | 0.006 | 0.013 | 0.35 | — | 0.29 | — | — | 0.05 | Inventive example |
| I | 0.242 | 0.09 | 0.51 | 0.005 | 0.0011 | 0.062 | 0.014 | 0.009 | — | 0.42 | 0.11 | — | 0.31 | 0.04 | Inventive example |
| J | 0.251 | 0.16 | 0.61 | 0.004 | 0.0013 | 0.077 | 0.006 | 0.019 | 0.19 | 0.21 | — | 0.21 | 0.19 | 0.03 | Inventive example |
| K | 0.230 | 0.31 | *0.26* | 0.006 | 0.0012 | 0.033 | 0.018 | 0.016 | 0.32 | 0.20 | — | — | — | — | Comparative example |
| L | 0.251 | 0.16 | 0.54 | 0.008 | 0.0021 | 0.025 | 0.021 | 0.011 | 0.21 | — | 0.10 | — | 0.24 | 0.05 | Comparative example |
| M | 0.223 | 0.41 | *1.14* | 0.007 | 0.0016 | 0.044 | 0.008 | 0.019 | 0.44 | — | — | — | — | 0.04 | Comparative example |
| N | *0.182* | 0.45 | 0.65 | 0.008 | 0.0020 | 0.033 | 0.021 | 0.017 | — | 0.36 | 0.21 | — | — | — | Comparative example |
| O | *0.283* | 0.14 | 0.61 | 0.005 | 0.0009 | 0.038 | 0.021 | 0.009 | 0.78 | — | 0.10 | 0.15 | 0.12 | — | Comparative example |
| P | *0.321* | 0.40 | 0.51 | 0.007 | 0.0014 | 0.025 | 0.015 | 0.012 | 0.71 | — | 0.15 | 0.21 | 0.18 | — | Comparative example |
| Q | 0.263 | 0.19 | *1.43* | 0.007 | 0.0007 | 0.040 | 0.019 | 0.010 | 0.43 | 0.08 | — | — | — | 0.05 | Comparative example |
| R | *0.274* | 0.24 | *0.95* | *0.013* | 0.0022 | 0.030 | 0.020 | 0.011 | 0.71 | — | 0.06 | — | 0.21 | — | Comparative example |
| S | 0.236 | 0.15 | 0.62 | *0.012* | 0.0016 | 0.035 | 0.022 | 0.014 | — | 0.31 | 0.22 | 0.25 | 0.16 | — | Comparative example |
| T | 0.226 | 0.43 | 0.87 | 0.008 | 0.0014 | 0.023 | 0.015 | *0.007* | 0.14 | 0.23 | — | — | — | — | Comparative example |
| U | 0.249 | 0.31 | 0.62 | 0.005 | 0.0018 | 0.038 | *0.003* | 0.014 | — | 0.55 | — | — | — | — | Comparative example |
| V | 0.241 | 0.30 | *1.05* | 0.006 | 0.0023 | 0.042 | *0.001* | 0.014 | 0.60 | 0.11 | — | — | — | 0.03 | Comparative example |
| W | 0.230 | 0.27 | 0.69 | 0.005 | 0.0010 | 0.028 | *0.039* | 0.008 | 1.01 | 0.05 | — | — | 0.41 | — | Comparative example |
| X | 0.254 | 0.26 | 0.55 | 0.004 | 0.0008 | 0.028 | 0.012 | 0.011 | 0.49 | 0.10 | 0.05 | — | — | — | Comparative example |
| Y | 0.255 | 0.21 | 0.77 | 0.009 | 0.0014 | 0.031 | 0.018 | *0.001* | 0.47 | 0.14 | — | — | — | — | Comparative example |
| Z | *0.284* | 0.13 | 0.46 | 0.007 | 0.0013 | 0.051 | 0.021 | 0.010 | 0.51 | — | — | — | — | — | Comparative example |

Note:
Underlined italic items are outside the scope of the present invention

TABLE 1-2

| Steel type | N | B | REM | Ca | Mg | DI | Ar3 (° C.) | Remarks |
|---|---|---|---|---|---|---|---|---|
| | (ppm) | | | | | | | |
| A | 32 | — | — | — | — | 47.1 | 719 | Inventive example |
| B | 41 | — | — | — | — | 46.8 | 718 | Inventive example |
| C | 24 | — | — | — | — | 54.4 | 743 | Inventive example |
| D | 52 | 12 | — | — | — | 62.0 | 717 | Inventive example |
| E | 44 | — | — | 22 | — | 49.6 | 725 | Inventive example |
| F | 38 | 14 | — | — | — | 49.8 | 721 | Inventive example |
| G | 27 | — | 57 | — | — | 98.3 | 739 | Inventive example |
| H | 22 | 11 | — | — | 14 | 52.6 | 732 | Inventive example |
| I | 14 | 8 | — | — | — | 47.3 | 716 | Inventive example |
| J | 45 | — | — | — | — | 50.2 | 713 | Inventive example |
| K | 22 | — | — | — | — | *31.5* | 753 | Comparative example |
| L | 30 | — | — | — | — | *33.0* | 722 | Comparative example |
| M | 27 | 5 | 32 | — | — | 65.1 | 701 | Comparative example |
| N | 44 | 10 | — | — | — | 52.0 | 752 | Comparative example |
| O | *61* | — | — | 23 | — | 64.3 | 694 | Comparative example |

TABLE 1-2-continued

| Steel type | N | B | REM | Ca | Mg | DI | Ar3 (° C.) | Remarks |
|---|---|---|---|---|---|---|---|---|
| | (ppm) | | | | | | | |
| P | 28 | — | — | 20 | — | 74.3 | 692 | Comparative example |
| Q | 38 | *36* | 50 | — | — | 93.2 | 658 | Comparative example |
| R | 35 | — | — | 14 | — | 80.9 | 676 | Comparative example |
| S | 44 | — | — | — | — | 52.0 | 721 | Comparative example |
| T | 59 | 11 | — | — | 20 | 56.8 | 720 | Comparative example |
| U | 41 | 10 | 40 | — | — | 52.8 | 718 | Comparative example |
| V | 31 | 7 | — | — | — | 91.9 | 690 | Comparative example |
| W | 53 | — | — | — | — | 84.5 | 695 | Comparative example |
| X | *62* | 22 | — | — | 19 | 51.9 | 721 | Comparative example |
| Y | 31 | 8 | — | — | — | 63.2 | 704 | Comparative example |
| Z | 55 | — | — | — | — | *33.1* | 715 | Comparative example |

Note:
Underlined italic items are outside the scope of the present invention

TABLE 2-1

| Steel plate No. | Steel type | Steel: Material (slab) thickness (mm) | Steel: Plate thickness (mm) | Hot rolling: Heating temperature (° C.) | Hot rolling: Rolling finishing temperature (° C.) | Hot rolling: Cooling method | Heat treatment: Heating temperature (° C.) | Heat treatment: Cooling method | Microstructure of steel plate: Microstructure | Microstructure of steel plate: Carbides, nitrides, carbonitrides of Nb and/or Ti (grains/mm$^2$) | Microstructure of steel plate: Average grain size of tempered martensite (μm) | Remarks |
|---|---|---|---|---|---|---|---|---|---|---|---|---|
| 1 | A | 250 | 16 | 1120 | 880 | Air cooling | 880 | Water cooling | Martensite | 1150 | 11 | Inventive example |
| 2 | A | 250 | 16 | 1120 | 900 | Air cooling | *Not heat-treated* | — | *Ferrite, pearlite, and* bainite | 1230 | *20* | Comparative example |
| 3 | A | 250 | 16 | 1120 | 900 | Air cooling | 880 | *Air cooling* | *Ferrite. pearlite, and* bainite | 1210 | *18* | Comparative example |

TABLE 2-1-continued

| Steel plate No. | Steel type | Steel: Material (slab) thickness (mm) | Steel: Plate thickness (mm) | Hot rolling: Heating temperature (° C.) | Hot rolling: Rolling finishing temperature (° C.) | Hot rolling: Cooling method | Heat treatment: Heating temperature (° C.) | Heat treatment: Cooling method | Microstructure of steel plate: Microstructure | Microstructure of steel plate: Carbides, nitrides, carbonitrides of Nb and/or Ti (grains/mm$^2$) | Microstructure of steel plate: Average grain size of tempered martensite (μm) | Remarks |
|---|---|---|---|---|---|---|---|---|---|---|---|---|
| 4 | B | 200 | 12 | 1120 | 850 | Air cooling | 850 | Water cooling | Martensite | 840 | 9 | Inventive example |
| 5 | C | 250 | 20 | 1150 | 900 | Water cooling | Not heat-treated | — | Martensite | 2840 | 12 | Inventive example |
| 6 | D | 300 | 25 | 1100 | 870 | Air cooling | 900 | Water cooling | Martensite | 630 | 13 | Inventive example |
| 7 | E | 200 | 10 | 1120 | 830 | Air cooling | 930 | Water cooling | Martensite | 1020 | 13 | Inventive example |
| 8 | F | 250 | 32 | 1150 | 930 | Water cooling | 900 | Water cooling | Martensite | 830 | 11 | Inventive example |
| 9 | G | 200 | 12 | 1070 | 860 | Water cooling | 200 | Air cooling | Martensite | 430 | 13 | Inventive example |
| 10 | H | 250 | 15 | 1150 | 860 | Water cooling | Not heat-treated | — | Martensite | 390 | 14 | Inventive example |
| 11 | I | 300 | 28 | 1120 | 850 | Air cooling | 900 | Water cooling | Martensite | 2060 | 11 | Inventive example |
| 12 | J | 250 | 25 | 1100 | 850 | Air cooling | 870 | Water cooling | Martensite | 210 | 10 | Inventive example |
| 13 | *K* | 250 | 20 | 1150 | 900 | Air cooling | 870 | Water cooling | *Bainite* | 2340 | 13 | Comparative example |
| 14 | *L* | 250 | 25 | 1120 | 870 | Water cooling | Not heat-treated | — | *Bainite* | 1170 | 12 | Comparative example |
| 15 | *M* | 200 | 25 | 1150 | 890 | Water cooling | Not heat-treated | — | Martensite | 1760 | 14 | Comparative example |
| 16 | *N* | 200 | 16 | 1120 | 850 | Air cooling | 900 | Water cooling | Martensite | 3120 | 12 | Comparative example |
| 17 | *O* | 200 | 25 | 1200 | 920 | Air cooling | 930 | Water cooling | Martensite | 2290 | 13 | Comparative example |

Note:
Underlined italic items are outside the scope of the present invention

TABLE 2-2

| Steel plate No. | Steel type | Steel material (slab) thickness (mm) | Plate thickness (mm) | Surface hardness HBW 10/3000 | Base material toughness vE-20 (J) | Stress corrosion cracking test $K_{ISCC}$ (kgf/mm$^{-3/2}$) | Remarks |
|---|---|---|---|---|---|---|---|
| 1 | A | 250 | 16 | 449 | 109 | 183 | Inventive example |
| 2 | A | 250 | 16 | *231* | 74 | 520 | Comparative example |
| 3 | A | 250 | 16 | *229* | 89 | 570 | Comparative example |
| 4 | B | 200 | 12 | 489 | 70 | 132 | Inventive example |
| 5 | C | 250 | 20 | 427 | 122 | 214 | Inventive example |
| 6 | D | 300 | 25 | 472 | 83 | 140 | Inventive example |
| 7 | E | 200 | 10 | 440 | 110 | 192 | Inventive example |
| 8 | F | 250 | 32 | 480 | 62 | 124 | Inventive example |
| 9 | G | 200 | 12 | 441 | 65 | 133 | Inventive example |
| 10 | H | 250 | 15 | 431 | 105 | 206 | Inventive example |
| 11 | I | 300 | 28 | 438 | 90 | 147 | Inventive example |
| 12 | J | 250 | 25 | 463 | 109 | 128 | Inventive example |
| 13 | *K* | 250 | 20 | *206* | 132 | 645 | Comparative example |
| 14 | *L* | 250 | 25 | *245* | 119 | 512 | Comparative example |
| 15 | *M* | 200 | 25 | 428 | 78 | *87* | Comparative example |
| 16 | *N* | 200 | 16 | *389* | 137 | 289 | Comparative example |
| 17 | *O* | 200 | 25 | 519 | 39 | *71* | Comparative example |

Note:
Underlined italic items are outside the scope of the present invention

TABLE 2-3

| Steel plate No. | Steel type | Steel material (slab) thickness (mm) | Plate thickness (mm) | Hot rolling: Heating temperature (° C.) | Hot rolling: Rolling finishing temperature (° C.) | Hot rolling: Cooling method | Heat treatment: Heating temperature (° C.) | Heat treatment: Cooling method | Microstructure of steel plate: Microstructure | Microstructure of steel plate: Carbides, nitrides, carbonitrides of Nb and/or Ti (grains/mm$^2$) | Microstructure of steel plate: Average grain size of tempered martensite (μm) | Remarks |
|---|---|---|---|---|---|---|---|---|---|---|---|---|
| 18 | *P* | 200 | 20 | 1150 | 900 | Water cooling | Not heat-treated | — | Martensite | 890 | 14 | Comparative example |
| 19 | *Q* | 250 | 32 | 1200 | 950 | Air cooling | 900 | Water cooling | Martensite | 320 | 11 | Comparative example |
| 20 | *R* | 180 | 20 | 1100 | 880 | Air cooling | 930 | Water cooling | Martensite | 670 | 12 | Comparative example |
| 21 | *S* | 250 | 16 | 1120 | 850 | Air cooling | 900 | Water cooling | Martensite | 1160 | 10 | Comparative example |
| 22 | *T* | 300 | 25 | 1150 | 920 | Water cooling | Not heat-treated | — | Martensite | *120* | *21* | Comparative example |
| 23 | *U* | 250 | 16 | 1120 | 850 | Air cooling | 880 | Water cooling | Martensite | *160* | *19* | Comparative example |
| 24 | *V* | 200 | 32 | 1050 | 870 | Air cooling | 900 | Water cooling | Martensite | *90* | *23* | Comparative example |
| 25 | *W* | 250 | 16 | 1200 | 900 | Water cooling | Not heat-treated | — | Martensite | 410 | 14 | Comparative example |
| 26 | *X* | 200 | 20 | 1150 | 900 | Water cooling | 200 | Air cooling | Martensite | 940 | 11 | Comparative example |
| 27 | *Y* | 200 | 12 | 1150 | 860 | Air cooling | 930 | Water cooling | Martensite | *180* | *25* | Comparative example |
| 28 | *Z* | 250 | 25 | 1150 | 900 | Air cooling | 900 | Water cooling | *Bainite* | 1380 | 14 | Comparative example |

Note:
Underlined italic items are outside the scope of the present invention

TABLE 2-4

| Steel plate No. | Steel Type | Steel material (slab) thickness (mm) | Plate thickness (mm) | Surface hardness HBW 10/3000 | Base material toughness vE-20 (J) | Stress corrosion cracking test $K_{ISCC}$ (kgf/mm$^{-3/2}$) | Remarks |
|---|---|---|---|---|---|---|---|
| 18 | *P* | 200 | 20 | *598* | *13* | *52* | Comparative example |
| 19 | *Q* | 250 | 32 | 501 | 38 | *80* | Comparative example |
| 20 | *R* | 180 | 20 | *522* | *24* | *59* | Comparative example |
| 21 | *S* | 250 | 16 | 439 | 88 | *91* | Comparative example |
| 22 | *T* | 300 | 25 | 435 | 60 | *95* | Comparative example |
| 23 | *U* | 250 | 16 | 462 | 79 | *78* | Comparative example |
| 24 | *V* | 200 | 32 | 456 | *22* | *65* | Comparative example |
| 25 | *W* | 250 | 16 | 432 | *19* | 104 | Comparative example |
| 26 | *X* | 200 | 20 | 490 | *28* | 118 | Comparative example |
| 27 | *Y* | 200 | 12 | 486 | *23* | *73* | Comparative example |
| 28 | *Z* | 250 | 25 | *369* | 42 | 289 | Comparative example |

Note:
Underlined italic items are outside the scope of the present invention

The invention claimed is:

1. A steel plate or steel sheet having a chemical composition comprising:

0.20% to 0.27% C, by mass %;
0.05% to 1.0% Si, by mass %;
0.30% to 0.90% Mn, by mass %;
0.010% or less P, by mass %;
0.005% or less S, by mass %;
0.005% to 0.025% Nb, by mass %;
0.008% to 0.020% Ti, by mass %;
0.1% or less Al, by mass %;
0.0010% to 0.0060% N, by mass %;
one or more of 0.05% to 1.5% Cr, by mass %, 0.05% to 1.0% Mo, by mass %, 0.05% to 1.0% W, by mass %, and 0.0003% to 0.0030% B, by mass %; and
Fe and incidental impurities, the steel plate or steel sheet having (i) a microstructure having a base phase or main phase that is tempered martensite, wherein a carbide, nitride, or carbonitride which has a grain size in the range of 0.01 μm to 0.5 μm in terms of equivalent circle diameter and which contains one or both of Nb and Ti is present at $2\times10^2$ grains/mm$^2$ or more, and (ii) a hardenability index DI* of 45 or more as represented by Equation (1), $$DI^*=33.85\times(0.1\times C)^{0.5}\times(0.7\times Si+1)\times(3.33\times Mn+1)\times(0.35\times Cu+1)\times(0.36\times Ni+1)\times(2.16\times Cr+1)\times(3\times Mo+1)\times(1.75\times V+1)\times(1.5\times W+1) \quad (1)$$

where each alloy element symbol represents the content, by mass %, and is 0 when not present, wherein an average grain size of the tempered martensite is 15 μm or less in terms of equivalent circle diameter.

2. The steel plate or steel sheet according to claim 1, wherein the chemical composition further comprises one or more of 1.5% or less Cu, by mass %, 2.0% or less Ni, by mass %, and 0.1% or less V, by mass %.

3. The steel plate or steel sheet according to claim 1, wherein the chemical composition further comprises one or more of 0.008% or less of an REM, by mass %, 0.005% or less Ca, by mass %, and 0.005% or less Mg, by mass %.

4. The steel plate or steel sheet according to claim 1, wherein a surface hardness of the steel plate or steel sheet is in the range of 400 to 520 HBW 10/3000 in terms of Brinell hardness.

5. The steel plate or steel sheet according to claim 1, wherein the microstructure includes 10 area % or less of untempered martensite.

6. A method for manufacturing a steel plate or steel sheet, the method comprising:

heating a steel material having a chemical composition comprising:

0.20% to 0.27% C, by mass %;

0.05% to 1.0% Si, by mass %;

0.30% to 0.90% Mn, by mass %;

0.010% or less P, by mass %;

0.005% or less S, by mass %;

0.005% to 0.025% Nb, by mass %;

0.008% to 0.020% Ti, by mass %;

0.1% or less Al, by mass %;

0.0010% to 0.0060% N, by mass %;

one or more of 0.05% to 1.5% Cr, by mass %, 0.05% to 1.0% Mo, by mass %, 0.05% to 1.0% W, by mass %, and 0.0003% to 0.0030% B, by mass %; and Fe and incidental impurities, the steel plate or steel sheet having (i) a microstructure having a base phase or main phase that is tempered martensite, wherein a carbide, nitride, or carbonitride which has a grain size in the range of 0.01 μm to 0.5 μm in terms of equivalent circle diameter and which contains one or both of Nb and Ti is present at $2\times10^2$ grains/mm$^2$ or more, and (ii) a hardenability index DI* of 45 or more as represented by Equation (1), $$DI^*=33.85\times(0.1\times C)^{0.5}\times(0.7\times Si+1)\times(3.33\times Mn+1)\times(0.35\times Cu+1)\times(0.36\times Ni+1)\times(2.16\times Cr+1)\times(3\times Mo+1)\times(1.75\times V+1)\times(1.5\times W+1) \quad (1)$$

where each alloy element symbol represents the content, by mass %, and is 0 when not present, to a temperature in the range of 1,000° C. to 1,200° C.;

performing hot rolling on the steel material to form a steel plate or steel sheet;

performing cooling on the steel plate or steel sheet;

performing reheating on the steel plate or steel sheet at a temperature in the range of Ac3 to 950° C.; and then performing quenching on the steel plate or steel sheet, wherein an average grain size of the tempered martensite is 15 μm or less in terms of equivalent circle diameter.

7. A method for manufacturing a steel plate or steel sheet, the method comprising:

heating a steel material having a chemical composition comprising:

0.20% to 0.27% C, by mass %;

0.05% to 1.0% Si, by mass %;

0.30% to 0.90% Mn, by mass %;

0.010% or less P, by mass %;

0.005% or less S, by mass %;

0.005% to 0.025% Nb, by mass %;

0.008% to 0.020% Ti, by mass %;

0.1% or less Al, by mass %;

0.0010% to 0.0060% N, by mass %;

one or more of 0.05% to 1.5% Cr, by mass %, 0.05% to 1.0% Mo, by mass %, 0.05% to 1.0% W, by mass %, and 0.0003% to 0.0030% B, by mass %; and Fe and incidental impurities, the steel plate or steel sheet having (i) a microstructure having a base phase or main phase that is tempered martensite, wherein a carbide, nitride, or carbonitride which has a grain size in the range of 0.01 μm to 0.5 μm in terms of equivalent circle diameter and which contains one or both of Nb and Ti is present at $2\times10^2$ grains/mm$^2$ or more, and (ii) a hardenability index DI* of 45 or more as represented by Equation (1), $$DI^*=33.85\times(0.1\times C)^{0.5}\times(0.7\times Si+1)\times(3.33\times Mn+1)\times(0.35\times Cu+1)\times(0.36\times Ni+1)\times(2.16\times Cr+1)\times(3\times Mo+1)\times(1.75\times V+1)\times(1.5\times W+1) \quad (1)$$

where each alloy element symbol represents the content, by mass %, and is 0 when not present, to a temperature in the range of 1,000° C. to 1,200° C.;

performing hot rolling on the steel material at a temperature in the range of 850° C. or higher to form a steel plate or steel sheet; and performing quenching on the steel plate or steel sheet at a temperature in the range of Ar3 to 950° C. immediately after finishing the hot rolling, wherein an average grain size of the tempered martensite is 15 μm or less in terms of equivalent circle diameter.

8. The method for manufacturing a steel plate or steel sheet according to claim 6, wherein, in the step of performing cooling, the steel plate or steel sheet is cooled to 300° C. or lower.

* * * * *